United States Patent [19]

Souka

[11] Patent Number: 5,063,618

[45] Date of Patent: Nov. 12, 1991

[54] PERSONAL HYGIENE DEVICE

[76] Inventor: Abbas F. Souka, 1318 Slatestone Ct., Raleigh, N.C. 27615

[21] Appl. No.: 582,651

[22] Filed: Sep. 12, 1990

Related U.S. Application Data

[63] Continuation-in-part of Ser. No. 479,367, Feb. 12, 1990, abandoned.

[51] Int. Cl.[5] ..... A47K 3/20

[52] U.S. Cl. ..... 4/420.4; 4/448

[58] Field of Search ..... 4/420.1–420.4, 4/448–447, 443

[56] References Cited

U.S. PATENT DOCUMENTS

| | | | |
|---|---|---|---|
| 2,605,477 | 8/1952 | Monserrat | 4/448 |
| 3,256,531 | 6/1966 | Arensberg | 4/448 |
| 3,425,066 | 2/1969 | Berger | 4/448 X |
| 3,430,268 | 3/1969 | Zoberg | 4/420.1 |
| 3,513,487 | 5/1970 | Palermo et al. | 4/420.4 |
| 3,605,124 | 9/1971 | Marcard et al. | 4/420.2 |
| 4,135,255 | 1/1979 | Menendez | 4/448 |
| 4,326,308 | 4/1982 | Silver | 4/420.3 |
| 4,334,329 | 6/1982 | Miyanaga | 4/420.4 X |
| 4,510,630 | 4/1985 | Osgood | 4/420.4 X |
| 4,596,058 | 6/1986 | Nourbakhsh | 4/420.4 X |
| 4,807,311 | 2/1989 | Ingels | 4/420.4 X |
| 4,995,121 | 2/1991 | Barker | 4/420.4 X |
| 4,998,300 | 3/1991 | Sharifzadeh | 4/420.4 |
| 5,003,645 | 4/1991 | Alonso | 4/448 |

FOREIGN PATENT DOCUMENTS

| | | | |
|---|---|---|---|
| 2447899 | 7/1976 | Fed. Rep. of Germany | 4/448 |

*Primary Examiner*—Henry J. Recla
*Assistant Examiner*—Robert M. Fetsuga

[57] ABSTRACT

A personal hygiene device uses water at a desired temperature to wash and/or treat the rectal and genital areas. The device includes a water carrying tube configured to conform to a toilet bowl and connected at one end to a source of water and at the other end to a showerhead. The device further includes a slotted bracket which secures the tube by a C-shaped clamp to the toilet bowl utilizing the existing toilet seat securing hardware. Angularly adjustable self-locking self-sealing slip on elbows having O-ring seals and split locking sleeves are used to connect the water carrying tube to the water supply line and to the showerhead.

3 Claims, 2 Drawing Sheets

PERSONAL HYGIENE DEVICE

REFERENCE TO RELATED APPLICATIONS

This application is a continuation in part of an application filed on Feb. 12, 1990, Ser. No. 479,367, now abandoned.

BACKGROUND OF THE INVENTION

1. Field of the Invention

Appropriate personal hygiene is important and vital to prevent inflammation of the rectal and genital areas as well as insuring cleanliness of the individual. Presently, toilet paper is the main instrument for cleaning said areas. Use of toilet paper is, however, marginally effective since it does not remove all traces of fecal and other matter that causes odor and inflammation. In addition, the rubbing action of toilet paper can cause skin irritation and its use contributes to environmental pollution.

Another area where the invention is applicable is use in the medical field. It is effective in post episiotomy care, hemorrhoid relief, post peri-anal surgical wounds and host of other applications.

2. Description of the Prior Art

Current practices which overcome such shortcomings use the bidet which is an extra washbowl mainly used for feminine hygiene. It requires floor space and sustantial expenditure. Other methods use spray nozzles installed inside the bowl or external handshowers. Some require elaborate designs that are expensive and impractical to implement. This is apparent from their usage of elaborate swinging fluid delivery pipes and complex mounting brackets. Most require location in the center of the commode each time it is in use which subjects them to contamination.

Sitz baths which are used in medical applications require installation, cleaning and storage everytime they are used.

Prior patents which are representative of the prior art in this field are: U.S. Pat. Nos. 2,605,477-8/1952; 3,513,487-5/1970; 3,605,124-9/1971; 4,069,519-1/1978; 4,340,980-7/1982; 4,135,255-1/1979; 4,642,820-2/1987; 4,807,311-2/1989; 4,334,329-6/1982; 4,242,764-1/1981; 3,425,066-2/1969.

SUMMARY OF THE INVENTION

This invention provides an exceedingly effective device for the purpose of cleaning and treating the rectal and genital areas which overcome the above noted drawbacks and which comprises a specially shaped tube (tubular wand) fitted with an angularly adjustable, self-locking, self sealing, slip on elbow-showerhead combination on the discharge side and with an angularly adjustable, self-locking, self-sealing, slip on elbow on the inlet side of the tube. The tube is affixed to the toilet bowl using a curved slotted universal snap-on bracket. One of the toilet seat retaining bolts holds the bracket in place between the toilet seat and the toilet bowl. The curved slot of the bracket permits installation of the tube or wand in commodes of different designs. The wand assembly is fixed in one location and does not require movement for use. Wand, showerhead, bracket and elbows can be made of copper, brass, plastic, steel or other suitable materials.

It is noted that the wand enters the bowl overlaying the flat top rim of the bowl, the vertical inside face of the bowl rim and then generally conforms to the contour of the bowl under the rim and to fit under the bowl rim and terminating at the center of the rear of the bowl. This offset entry configuration keeps the wand and elbow-showerhead closest to the inner corner of the rear of the rim at the highest elevation above the water level in the bowl. This guarantees that no water contamination of the showerhead will take place since no flooding of showerhead would occur during flushing of toilet. It also minimizes the protrusion of the showerhead away from the back wall keeping it well behind the toilet seat opening thus protecting it against contamination during defecation.

A straight hand held tubular wand may be used for satisfying the personal hygiene needs for individuals who may be bed-ridden and who use bed pans. Such wand is equipped with a self-sealing self-locking slip on union connection which connects to the tubular wand on one end and to the showerhead on the other end. On the other end of the wand, a valve is fitted to regulate the water leaving the showerhead. A self-sealing self-locking, push to connect fitting is used to connect wand to valve. The other end of the valve is connected to flexible tubing by means of a barbed fitting.

Water at the desired temperature is delivered to the wand by branching off appropriate hot and cold water lines supplying the bathroom and mixing hot and cold water in such quantities as to obtain the temperature and flow required by the wand user.

An alternate unique water delivery system is comprised of a combination diverter aerator which replaces the aerator commonly installed on water faucets. The diverter aerator is connected to the wand through appropriate tubing. This alternate water delivery system is used by adjusting the temperature of the water to the desired level as it flows through the faucet into the sink in the normal way. To divert the water to the wand, the diverter's knob is pulled outwards. The flow of water through the wand can be stopped by pressing the diverter's knob inwards or by turning off the faucet. A valve may be placed in the line between the diverter and the wand for additional flow control, a pinch or a wedge clamp may also be used for the same purpose. This valve is required if this water delivery system is used in situations where the faucet and diverter aerator can not be reached by the person seated on the commode without leaving the commode.

DESCRIPTION OF THE PREFERRED EMBODIMENT

Figure 2:
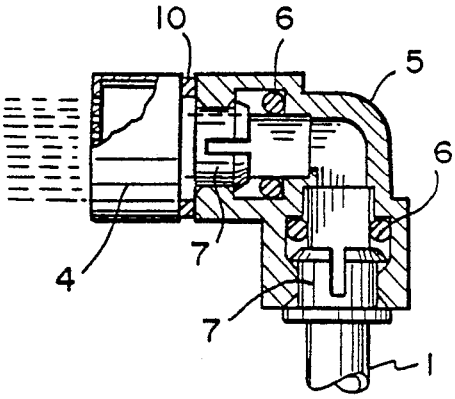
FIG. 2 is a section through the elbow-showerhead assembly showing the method of sealing and locking of showerhead and wand to the elbow.
Figure 3:
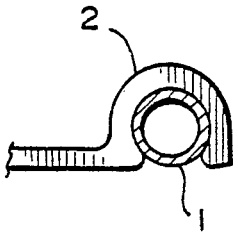
FIG. 3 shows the method of clamping of wand by the bracket.
Figure 1:
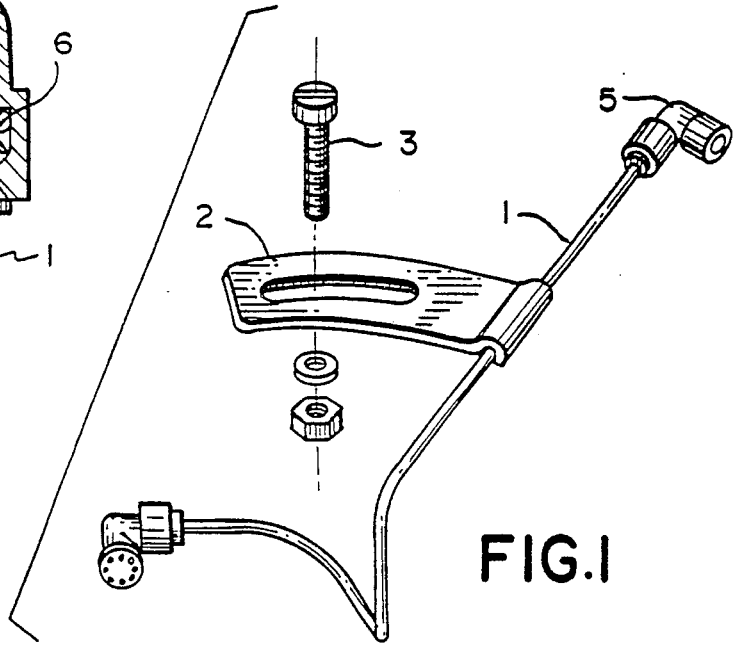
FIG. 1 shows an isometric of personal hygiene device assembly and method of attaching it to the commode.
Figure 4:
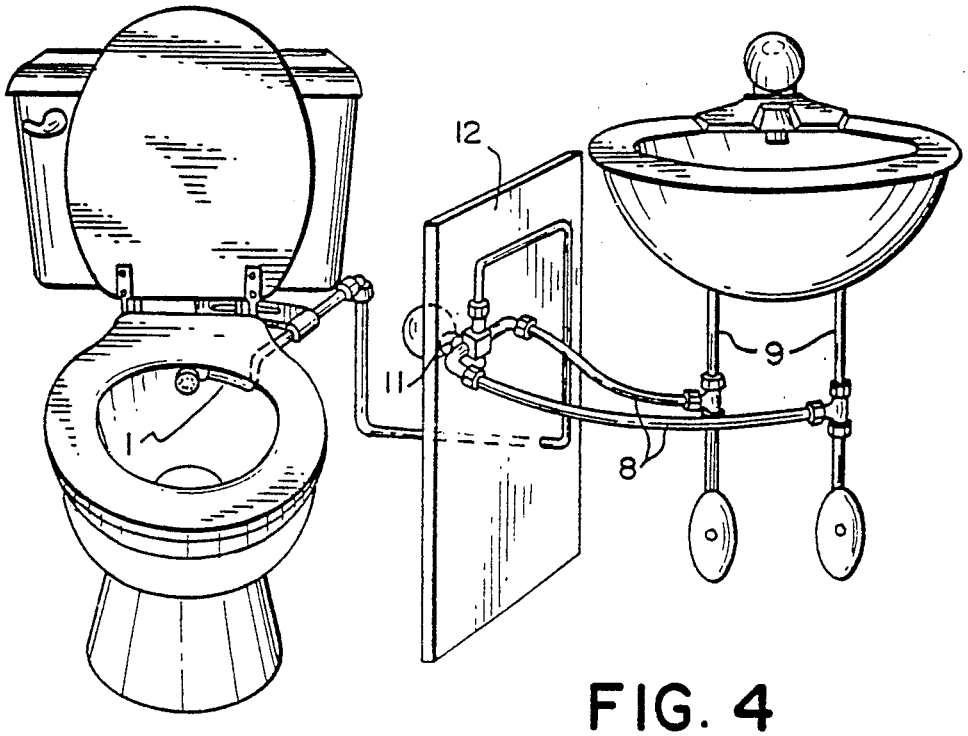
FIG. 4 shows wand installed inside commode and supplied with water through a mixing valve.
Figure 5:
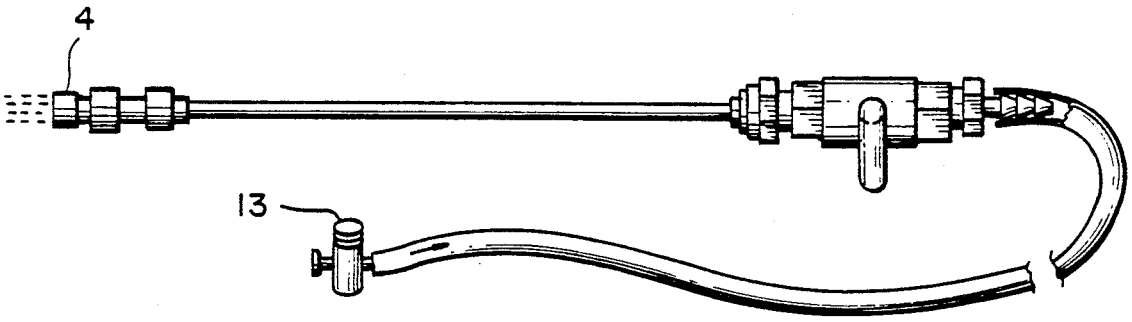
FIG. 5 shows the straight wand assembly.
Figure 6:
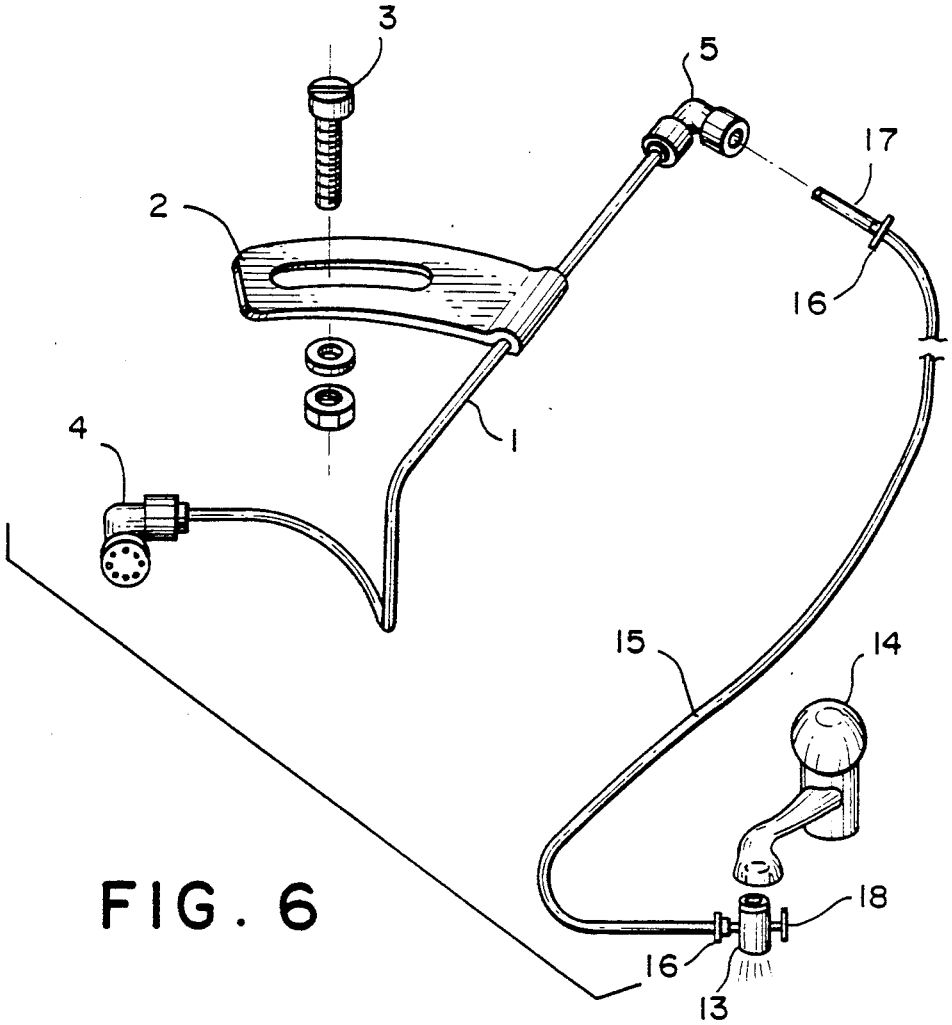
FIG. 6 shows the preffered embodiment.

Referring to the drawings wherein like reference numbers designate like corresponding parts throughout the several figures, there is shown in FIG. 1 a personal hygiene device having a fluid delivery tube or a tubular wand 1. The wand is fixed in its place by means of a curved slotted bracket 2 which snaps on the wand as depicted in FIG. 3. The bracket is in turn held in its place between the top of the commode and the toilet seat by one of the retaining bolts 3 holding the toilet seat in place. The curved slotted bracket permits installation of the wand in commodes of varying designs. The showerhead 4 is connected to the wand by means of a slip on elbow 5 shown in section in FIG. 2. The O-ring seals 6 prevent leakage of the water passing through and the locking sleeves 7 keep the assembly from inadvertently coming apart. O-ring 13 maintains the proper alignment of the showerhead. Water is fed to the wand through the slip on elbow 5.

The water delivery system consists of a diverter aerator assembly 13 which is screwed on bathroom faucet 14 in place of the conventional aerator. The diverter is connected to the wand by flexible tubing 15. Clamps 16 secure connection of the tubing to the diverter 13 and insertion tube 17 which connects the tubing to the swivel elbow 5. In order to use this water delivery system, the flow and water temperature are adjusted by manipulating the faucet in the normal way. The diverter's knob 18 is then pulled outwards and the flow is automatically diverted through the tubing to the tubular wand. In order to stop the flow knob 18 is pushed inwards rediverting the flow to the sink. Shutting the water faucet 14 will also automatically disconnect the water delivery system and return the knob 18 to the inactive position.

What I claim as new and desired to be secured by Letters Patent of the United States is:

1. A personal hygiene device for use with a toilet bowl having an upper rim and a seat hinged to a rear portion of the bowl, said seat hinge being secured to said bowl by at least one bolt retainer, said personal hygiene device comprising:

a water carrying tube having an inlet end adapted to be connected to a source of water, said tube being configured to extend over the toilet bowl rim and down into the bowl, said tube further being configured to extend toward said rear portion of the toilet bowl generally conforming to the contour thereof under the rim, said tube terminating in an outlet end adapted to be positioned substantially at the rear center of the toilet bowl, said outlet end having a forwardly directed showerhead connected thereto; and, a positioning bracket for securing said water carrying tube to the toilet bowl, said bracket being substantially planar and having an arcuate slot in a first end portion thereof, said bracket first end portion adapted to be positioned between the toilet seat hinge and toilet bowl and secured to the toilet bowl by the bolt retainer passing through said slot, said bracket having an opposing second end portion terminating in a downwardly open C-shaped clamp engaging said tube at said portion extending over the toilet bowl rim when said bracket first end portion is secured to the bowl;

whereby said arcuate slot enables adjustable positioning of said water carrying tube to accommodate various toilet bowl shapes to position said showerhead at said substantially centered position.

2. A personal hygiene device as defined in claim 1, wherein the connection between said water carrying tube and the source of water comprises an angularly adjustable, self-locking, self-sealing slip-on elbow having o-ring seals and split locking sleeves.

3. A personal hygiene device as defined in claim 1, wherein the connection between said water carrying tube and said showerhead comprises an angularly adjustable, self-locking, self-sealing slip-on elbow having o-ring seals and split locking sleeves.

* * * * *